US007512465B2

(12) United States Patent
Gai

(10) Patent No.: US 7,512,465 B2
(45) Date of Patent: Mar. 31, 2009

(54) DIRECTIONAL CONTROL SYSTEM AND METHOD FOR MARINE VESSELS, SUCH AS SHIPS AND THE LIKE

(75) Inventor: Giorgio Gai, Genoa (IT)

(73) Assignee: Ultraflex SpA, Casella (GE) (IT)

( * ) Notice: Subject to any disclaimer, the term of this patent is extended or adjusted under 35 U.S.C. 154(b) by 459 days.

(21) Appl. No.: 11/129,860

(22) Filed: May 16, 2005

(65) Prior Publication Data

US 2005/0252433 A1 Nov. 17, 2005

(30) Foreign Application Priority Data

May 17, 2004 (IT) ..... SV2004A0023

(51) Int. Cl.
*B60L 3/00* (2006.01)
*G05D 3/00* (2006.01)
*G06F 7/00* (2006.01)

(52) U.S. Cl. ..... 701/21; 114/144 R; 114/144 RE; 318/588; 440/84

(58) Field of Classification Search ..... 701/21; 114/144 R, 144 RE; 318/588; 440/84
See application file for complete search history.

(56) References Cited

U.S. PATENT DOCUMENTS 5,107,424 A * 4/1992 Bird et al. ..... 701/21

FOREIGN PATENT DOCUMENTS

EP 1 382 845 A2 1/2004

* cited by examiner

*Primary Examiner*—Khoi Tran
*Assistant Examiner*—Nikhil Sriraman
(74) *Attorney, Agent, or Firm*—Themis Law

(57) ABSTRACT

A directional control system for a marine vessel comprising a steering mechanism movable between two extreme opposite positions and capable of altering the direction of the marine vessel; an actuator for moving the steering mechanism between the two extreme opposite stop positions; a directional control station comprising a control element movable between two opposite positions to set a directional steering; and an electrical transmission system transmitting to the actuator the movement stroke of the control element or the position of the control element in the total stroke between the two opposite stop positions. The electrical transmission system transforms the movement stroke of the control element, or the position of the control element, into an actuation signal for the actuator according to a function univocally correlated with the position of the steering mechanism, thereby causing the steering mechanism to assume a steering position that directly corresponds to the actuation signal.

17 Claims, 8 Drawing Sheets

DIRECTIONAL CONTROL SYSTEM AND METHOD FOR MARINE VESSELS, SUCH AS SHIPS AND THE LIKE

CROSS-REFERENCE TO RELATED APPLICATIONS

The present patent application claims priority under 35 U.S.C. §119 to Italian patent application SV2004A000023, filed on May 17, 2004.

STATEMENT REGARDING FEDERALLY SPONSORED REASEARCH AND DEVELOPMENT

Not applicable.

REFERENCE TO A COMPUTER LISTING, A TABLE, OR A COMPUTER PROGRAM LISTING COMPACT DISK APPENDIX

Not applicable.

BACKGROUND OF THE INVENTION

1. Field of the Invention

The present invention relates to a directional control system for a marine vessel, and, more particularly, to a directional control system wherein a stroke of the control element, for example, of the steering wheel, or a position of the control element with respect to the total stroke, is transmitted electrically to a steering device, such as a rudder.

2. Description of Related Art

Directional control systems in the prior art are known as steerage systems, and generally comprise a control element, such as a steering wheel, a rudder wheel or a rudder tiller, and a steering mechanism, which may comprise a rudder blade that is rotatable about a vertical shaft. In alternative or in addition to the rudder blade, the steering mechanism may comprise a sterndrive of an outboard motor or in-outboard motor, wherein the sterndrive bears a propeller and is mounted in a rotatable fashion like the rudder blade.

In the prior art, the steering wheel, the rudder wheel, or the rudder tiller are connected to the rudder blade or the sterndrive of an outboard or in-outboard motor with mechanical devices, such as an arrangement of cables transmitting to the motor sterndrive or blade the rotational motion of the steering wheel or of the rudder wheel, or the angular movement of the rudder tiller. Servo-driven systems are also known in the prior art, wherein the mechanical transmission occurs by means of hydraulic or oil-pressure transmission systems. In these systems, a pump is mechanically connected to the control element and is part of a closed hydraulic circuit comprising a double-acting actuating cylinder and, in some instances, a hydraulic motor. The change in pressure between the two branches of the hydraulic circuit, caused by the movement of the control element due to a manual steering or due to a change in direction of the steering wheel, of the rudder wheel, or of the rudder tiller, causes the actuating cylinder to be actuated in one or the other direction, or causes the hydraulic motor to be rotated in one or the other direction, forcing the rudder blade or the sterndrive of the outboard or in-outboard motor to move angularly.

Yet the directional control systems in the prior art present a number of drawbacks.

A first drawback is that the assembly of purely mechanical and hydraulic systems requires the passage of pull and push cables or of hydraulic piping running through the ship vessel or parts thereof. Therefore, special housings must be provided for the cables or the hydraulic piping, and such housings must be easy to access for control and replacement purposes. Moreover, the housings must be large enough to enable the free sliding of cables within their sheaths, or the passage of pressure fluid pipes of the hydraulic system, as well as the assembly and replacement of such cables and pipes.

Another drawback is the complexity of adding additional, secondary steerage stations, because the mechanical and hydraulic integration of cables and pipes connected to the secondary stations with the cables and pipes already in place is extremely difficult or even impossible without substantial changes to the stations already in place.

Still another drawback is the need to adjust only with mechanical or hydraulic means the function that correlates the position of the steering control element with the corresponding position of the dipped steering mechanism, for instance, the function correlating the angular position of the steering wheel with the angular position of a rudder blade or sterndrive of an outboard motor, only with mechanical or hydraulic means, because the steering control element and the dipped steering mechanism are integrated with a mechanical system (cables and tie rods) or a hydraulic system (connections of fluid piping and possible distribution). Such adjustments must be frequently carried out, since both mechanical systems and hydraulic systems are subject to a degradation in their operating conditions, for instance, to an increase in slacks, a decrease in the amount of fluid, or other wear-related effects. In this situation, a system examination must be carried out for in the entire mechanical or hydraulic system, since cables may broken at any point, and fluid pipes may leak or be broken in different points.

Yet another drawback is the inherent lack of flexibility of the functions correlating the position of the control element with the position of the steering mechanism in the prior art, which prevents these functions from being changed or modified, and also make it problematic to execute or integrate diagnostic and emergency systems and functionalities.

A further drawback is the difficulty in integrating the steerage systems in the prior art within an electronic function control system, for instance, for accelerating or reversing control.

BRIEF SUMMARY OF THE INVENTION

The present invention overcomes the drawbacks of the prior art by providing a directional control system and a directional control method for a marine vessel wherein the movement stroke of the control element or the position of the control element with respect to the total stroke is transmitted electrically to the steering mechanism.

Briefly, a directional control system for a marine vessel is provided that comprises a steering mechanism movable between two extreme opposite positions and capable of altering the direction of the marine vessel; an actuator for moving the steering mechanism between the two extreme opposite stop positions; a directional control station comprising a control element movable between two opposite positions to set a directional steering; and an electrical transmission system transmitting to the actuator the movement stroke of the control element or the position of the control element in the total stroke between the two opposite positions. The electrical transmission system transforms the movement stroke of the control element, or the position of the control element, into an actuation signal for the actuator according to a function univocally correlated with the position of the steering mechanism, thereby causing the steering mechanism to assume a steering position that directly corresponds to the actuation signal.

A method is further provided for the directional control of a marine vessel by means of a directional control system, wherein the movement stroke of the control element of the marine vessel or the position of the control element with respect to the total stroke is transmitted electrically to the steering mechanism.

In one embodiment, the control element is associated to an electromechanical transducer that generates an electrical signal univocally correlated to the stroke made by the control element or to the position taken by the control element with respect to its total stroke.

When the control element is of the type that is rotatable about an axis or that can be angularly moved, such as a steering wheel, a rudder wheel, or a rudder tiller, a potentiometer may be used as a transducer. In this event, the slider of the potentiometer is mechanically coupled to the shaft of rotation or the angular movement of the control element, for example by using a rotating slider, wherein the spindle of the slider is connected directly or by means of a reduction unit to the shaft of the control element. Alternatively, optical and electromagnetic encoders or similar devices may be used as potentiometers to detect the rotation of the spindle of the steering wheel and to generate a signal correlated to the angle of rotation.

Alternatively, a lever may be used as a control element, even if this solution may be of lesser interest to certain users because of reduced functionality.

The steering mechanism is dipped in water at least partially, and is controlled by an actuator that may assume different variants.

In one variant, the actuator is electrical, such as a rotatable electrical motor or an electromechanical linear actuator. In this variant, the electrical signal that is univocally correlated to the stroke or to the position of the control element is provided as control signal thereof to a power supply unit of the electric motor or of the electromechanical linear actuator. The power supply unit then actuates the electrical motor or the linear electrical actuator for an amount of time sufficient for making the stroke or for reaching the position of the steering mechanism that is univocally correlated to the stroke or position of the control element that are transmitted as electrical signal.

In a second variant provides, an electrical actuator, such as an electrical motor or an electromechanical linear actuator, controls a pump or a hydraulic motor that drives a hydraulic actuator, and the pump or the hydraulic motor, and the hydraulic linear actuator, are provided within a closed hydraulic circuit that drives the steering mechanism. In this variant, the hydraulic system driving the steering mechanism is locally provided in the area of the steering mechanism, particularly in the area of the shaft of rotation or of angular movement of the steering mechanism.

In a third variant, instead of the hydraulic system driving the steering mechanism, there is provided a mechanical system that drives a steering mechanism comprising transmission tie rods or cables, and the electrical motor or the electromechanical linear actuator is dynamically connected to the tie rods or cables. In this variant, the mechanical system that drives the steering mechanism may be locally provided near the steering mechanism, and, when the steering mechanism has a shaft of rotation, at said shaft.

In the above described embodiment combining a steering control electrical signal and a hydraulic actuator for the steering mechanism, the directional control system according to the present invention comprises:

a steering mechanism that can be at least partially dipped in water and that is rotatable about an axis contained in a plane parallel to the longitudinal axis of the ship or coinciding with said axis, wherein the steering mechanism can be moved between two extreme opposite positions each correlated to a maximum directional steering angle of the marine vessel in relation to a straight traveling direction;

a directional control station of the marine vessel comprising a control element for setting the directional steering, wherein the control element is movable between two extreme opposite stop positions;

an electro-mechanical transducer transducing the movement stroke of the control element or the position of the control element with respect to the total stroke, wherein the means for electro-mechanically transducing generate an electrical signal univocally correlated to the movement stroke of the control element or to the position of the control element with respect to the total stroke;

a power supply unit for an electrical motor, wherein the power supply unit is connected to the electro-mechanical transducer associated to the control element and receives the electrical signal generated by the transducer;

a hydraulic circuit driving the steering mechanism, wherein the hydraulic circuit comprises a double-acting, linear, hydraulic actuator and a pump for supplying the hydraulic fluid to the hydraulic actuator; and a fluid reverser capable of reversing the fluid flow under pressure to the hydraulic double-acting actuator, wherein the fluid reverser comprises a combination of electrically activated valves or a reversible pump, wherein the hydraulic pump is driven by the electrical motor and the electrically activated valves (if present) that reverse the fluid flow direction under pressure to the hydraulic actuator are controlled by the power supply unit of the electrical motor, and wherein the stroke of the control element causes the actuator moving the dipped steering mechanism to be actuated according to a function correlating the movement stroke or the position of the control element within the total stroke thereof with the movement stroke or the position of the steering mechanism.

Advantageously, the electromechanical transducer associated to the steering control element and the power supply unit are connected to local, intelligent, dedicated units or may integrate local intelligent dedicated units.

More particularly, the electromechanical transducer and the power supply unit have a control and processing electronic portion comprising a CPU, at least an input portion, and at least an output portion that are composed of communications units working according to a predefined communications protocol.

Processing portions dedicated to functions to be carried out therefrom may be provided instead of CPU. In addition to the CPU and/or to processing portions, a program memory may be provided, wherein an operating program of the transducer and of the power supply unit is loaded.

The operating program may comprise various routines for executing different tasks. The operating program may further comprise the algorithm that computes the function univocally correlating the position or stroke of the control element with the position or stroke of the steering mechanism. Such function may be in the form of a computational algorithm executed each time the control element is driven or in the form of a correlation table stored in the memory of the corresponding portion, that is, of the electromechanical transducer, of the associated unit, or of the power supply unit.

The operating program may comprise, among others, diagnostic subroutines, subroutines indicating an error or a malfunction, adjusting subroutines, subroutines setting the correlation function, and activation and deactivation and initializing subroutines. The communications protocol may be of any type, for example, the protocol that is presently widely used in the nautical field called BUS CAN. However, it should be understood that the present invention is not limited to this protocol.

Following is a summary of other embodiments of the invention.

According to one aspect of the invention, a device for indicating the set position of the steering mechanism may be connected to the electromechanical transducer generating the electrical signal correlated to the stroke made by the control element or the position taken by the control element, or to a related electronic control and processing unit, the position of the steering mechanism, also called the rudder angle, resulting from the correlation developed by the correlation function in the operating program and derived from the stroke made by the control element or from its position.

An electromechanical detector for the actual position of the steering mechanism, that is, for the called actual rudder angle, may also be associated to the hydraulic actuator or to the shaft of the steering mechanism. The signal generated by such detector is then transmitted to the electromechanical transducer, or to an associated control and processing electronic unit that is capable of comparing the nominal rudder angle set by the control element with the angular position actually taken by the steering mechanism, that is, with the actual rudder angle.

When the electromechanical transducer or the associated processing and control electronic unit are provided with a CPU executing an operating program, the detector signal associated to the actuator or to the steering mechanism is processed by a comparison subroutine provided in the operating program.

The signal of the rudder angle detector associated to the actuating cylinder or to the steering mechanism may be further provided to the power supply unit, which in turn has a comparing portion similar to that of the processing and control unit of the control element. Alternatively, the power supply unit may have a CPU for executing an operating program, and the signal of the rudder angle detector is provided to a comparing subroutine of the operating. program. The detector of the rudder angle may be also integrated in the actuating cylinder.

In a different embodiment of the present invention, the power supply unit generates a control signal for the electrical motor that drives the pump controlling the actuating cylinder that corresponds to a predetermined fixed movement speed of the steering mechanism and that is independent of the movement speed of the control element.

A variant provides that the movement speed of the steering mechanism is variable between a minimum speed and a maximum speed, and that the steering mechanism is movable at the movement speed of the control element when such speed is within the range between the minimum and maximum speeds.

A table may also be provided for selecting the fixed movement speed or the minimum and maximum speeds, and the user can set the fixed speed or the minimum and maximum speeds for moving the steering mechanism from those provided in the table. The table is stored in the electronic board associated to the electromechanical transducer of the control element or in the power supply unit, and a subroutine is provided for selecting and changing the fixed speed or the minimum speed and maximum speeds in the operating program.

In another embodiment of the present invention provides, the directional control system is provided with two, three or more control stations. Each control station comprises a control element, with its own electro-mechanical transducer and with a dedicated local processing and control unit. Moreover, each station has command input means for disabling or enabling the station, in order to transfer the control function to a different station of the two, three or more further stations.

Advantageously, the disabling/enabling command is composed of a code comprising at least two different pulses, preferably at least three or more different pulses. The code is entered through an input point provided on the control panel of each station, and the input point of the code is connected to the processing and control local unit. These codes are transmitted to the processing and control unit of the power supply unit of the actuator that drives the steering mechanism via communication lines that transmit command signals to the steering mechanism, and through a transmitting protocol that can be the same or different from that used for the command signals of the steering mechanism. More particularly, the transmitting protocol may be the protocol called BUS CAN.

Enabling and disabling codes may be stored in a memory of the processing and control units associated to the control element or the power supply unit. These codes may also be associated to an identification code of the control station.

The directional control system according to the present invention may also comprise an emergency system in the event of a transmission failure between the actuator driving the steering mechanism and the power supply unit of the actuator or the control element. In this event, the power supply unit is unable to properly control the motor of the hydraulic pump or any motors directly driving the steering mechanism. Therefore, a switch is provided that can be at least manually actuated and that directly commutes power supply inputs from the motor into outputs of an electromechanical power supply unit controlled by means of buttons. This electro-mechanical power supply unit comprises a remote control switch that is controlled by two buttons for driving the motor in one direction and in the opposite one.

By further providing sensors of operative parameters of the system in combination with the electronic processing and control units associated to the control element, and to the actuator driving the steering mechanism, it is possible to actuate the emergency system automatically and to enable/disable the emergency system, or at least to indicate the need to actuate the emergency system.

The directional control system according to the present invention has the additional advantages of being easy to assemble and of being very flexible with respect to adjustment, setting and maintenance. The directional control system according to the present invention is also very flexible with respect to the provision of specific tasks, which can be integrated by simply loading the control software in memories of local processing and control units.

The directional control system according to the present invention can also be easily integrated with other board device systems that operate with a transmission bus of command signals and feedback signals.

An additional system that can be easily integrated, or otherwise put in communication and enabled to work with the directional control system, is a system that controls the acceleration of motors and also controlling reverser. Even in this case the stations controlling the acceleration of the motor and controlling the reverser are provided with control elements, such as pivoting levers, that move along a predetermined path generating a signal univocally correlated to the stroke or position and transmitted to an actuating unit, for example a power supply unit of an actuator driving mechanisms capable of accelerating the motor or the reverser.

In order enable the directional steering system and the accelerating/reversing system to communicate, so to have a cooperative and synchronized mode control for driving the motors and the steering mechanism, the two systems are connected to each other with the electric control or feedback signals, by means of an interfacing portion that constitutes both a communication node and a local, intelligent unit interpreting electric control and feedback signals of the two systems, and also and by means of a control and synchronization program managing maneuverings that are set non-conflictually by the two systems.

The interfacing portion may also convert signals in a communication protocol that is common with other devices such as an automatic pilot, a radar, a sonar, a satellite navigations system, a weather information source, and the B station for an automatic and synchronized execution of marine vessel steering maneuverings.

The embodiment of the present invention with the above variants is fairly complete, but also requires the highest costs because presence and the integration of the control element and the actuator require electronic intelligent units, making the directional control system more expensive than simpler versions.

In a different embodiment, it is possible to perform more complex tasks with lower costs by the use of a less complex hardware structure. In this embodiment, the intelligent processing unit associated to the transducer is removed and a different type of electro-mechanical transducer is used to transform the movement of the control element into a directional steering. More specifically, the detection of the stroke or position of the control element to set the directional steering comprises the use of an opto-electronic transducer.

In one embodiment, the control element setting the directional steering comprises an element rotating about an axis, while the transducer comprises an angular position sensor, also called an encoder that works opto-electronically. In particular, the encoder includes an angular movement optical sensor that comprises a radiation source oriented towards a radiation detector, and a shield positioned between the radiation source and the radiation detector that is provided with a plurality of through slots alternated with full areas, wherein the through slots extend along a path coinciding with the position of the detector and of the opposing radiation source.

The shield comprises a disk rotating with the control element, while the through slots are arranged on a circumference with a radial distance coinciding with the radial distance at which the emitter/receiver pair is situated. The through slots are alternated with full areas, and at such an angular distance that the detector of the emitter/receiver pair emits a receiving pulse for every two degrees of rotation.

By having a transducer with an encoder as described above, a stroke of the control element is not necessary for setting the directional steering. The rotation speed of the directional control element can be detected by the encoder, which is provided with a pulse counter over a time unit and a timer measuring time.

Further, the encoder may be provided in combination with means for detecting the movement direction, particularly the rotation direction of the directional control element. In one embodiment, these means comprise providing the shield with a row of through slots having a predetermined distance one with respect, and at least a pair of detectors in a radial position coinciding with the row of through slots but staggered one with respect to the other by a distance that is greater or lower than the distance between two contiguous through slots. Therefore, when a detector is perfectly centered with a through slot, the second detector partially coincides with a different through slot, and the substantially square wave alternate signals generated by the two detectors have a predetermined phase one with respect to the other.

More particularly, the distance between the two detectors may be such that when the sensitive surface of a first detector perfectly and completely coincides with a first through slot, the sensitive surface of the second detector coincides with only half of a second through slot, and the remaining part of the sensitive surface of the second detector coincides with the full (not transparent) part between individual through slots. Depending on the direction of movement, and particularly on the direction of rotation of the directional control element, and, therefore, of the shield and of the corresponding row of slots, square wave signals generated by the two detectors will have then a phase difference, which will substantially have an absolute value identical for the two movement directions of the directional control element, because the signal of the first detector will anticipate the signal of the second detector and vice versa according to the direction of movement of the directional control element.

In this embodiment, the signals generated by the encoder and transformed in pulses per unit of time are sent to an interfacing unit that comprises a converter transforming these signals into an appropriate format, to be read by the central processing unit associated to the power supply unit driving the steering mechanism. In particular, the signal converter transforms output signals from the counter and, depending on the number of pulses per unit of time and to the detected difference of phase generated by the encoder, in communications signals according to a Bus Scan communications protocol.

These and other aspects of the invention are claimed in the enclosed claims.

BRIEF DESCRIPTION OF THE SEVERAL VIEWS OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

DETAILED DESCRIPTION OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1:
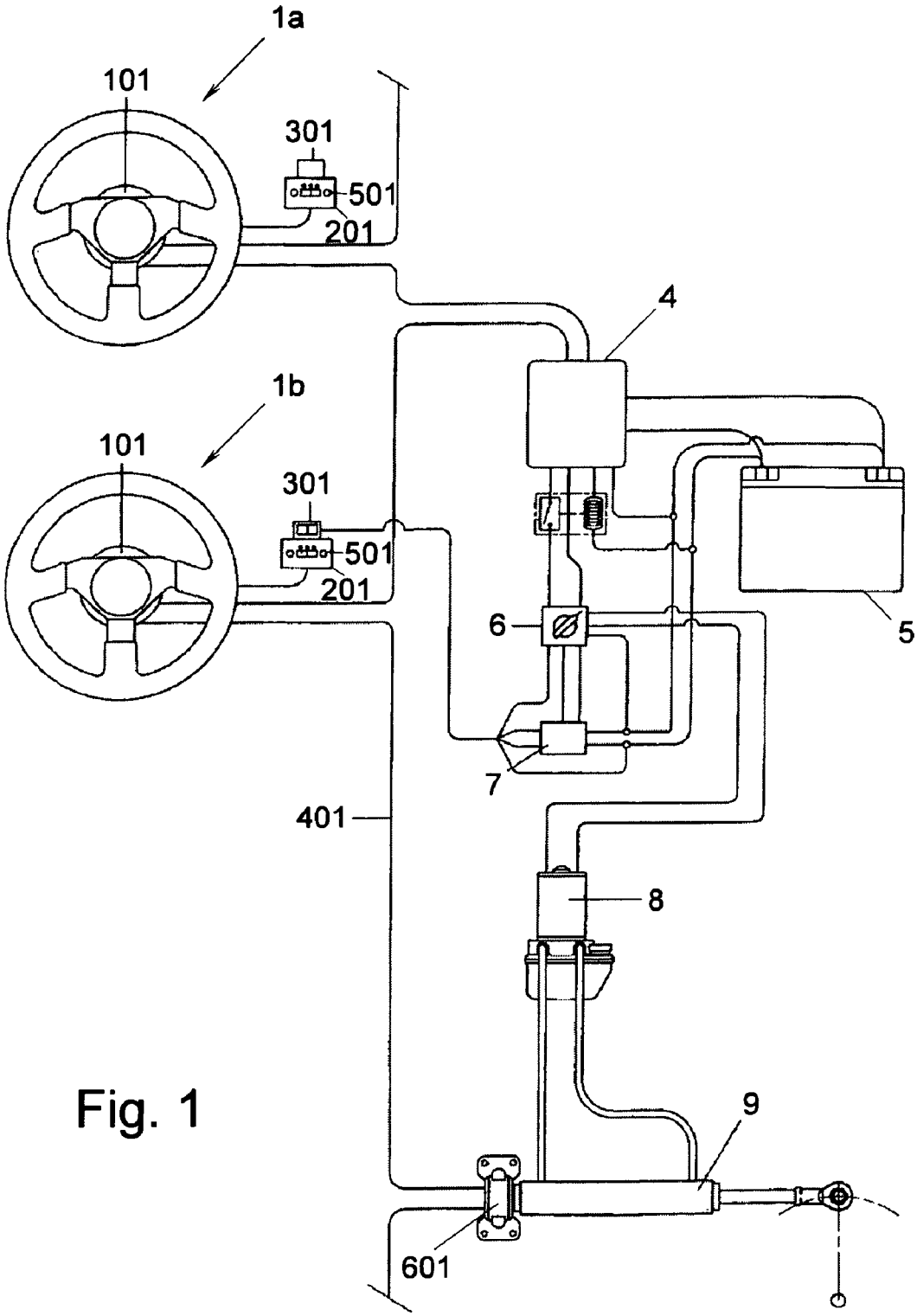
FIG. 1 is a first schematic diagram of a first embodiment of the invention, wherein two control stations for steering the marine vessel are provided.
Figure 2:
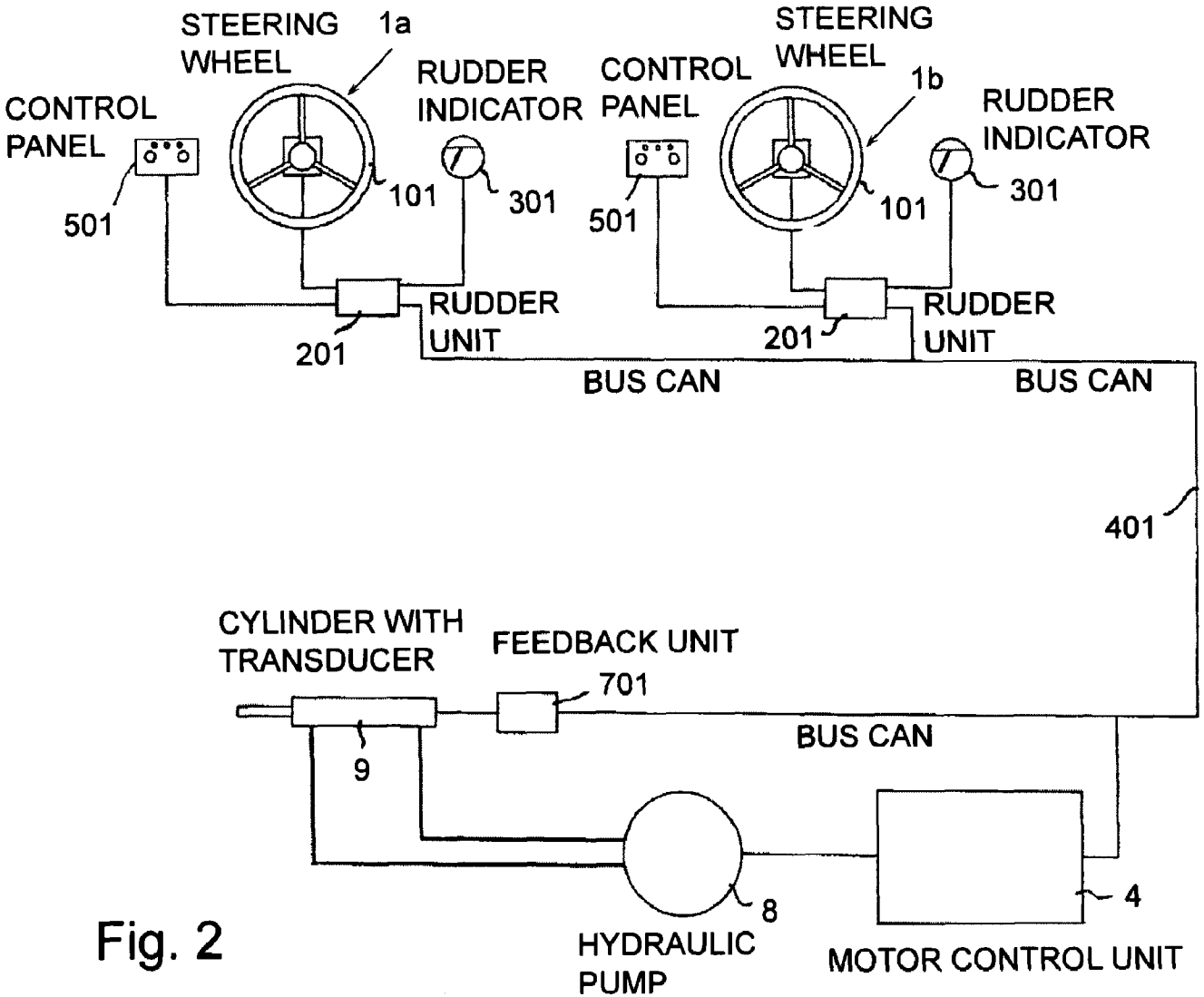
FIG. 2 is a second schematic diagram of the first embodiment of the invention, wherein two control stations for steering the marine vessel are provided.

Referring first to FIGS. 1 and 2, there is shown a first embodiment of a directional control system for marine vessels or similar systems according to the present invention. The first embodiment comprises two control stations 1*a* and 1*b*, each having a control element in the form of a rotatable mounted steering wheel 101. An electromechanical transducer, such as a potentiometer or a similar instrument, is dynamically connected to the shaft of rotation thereof (not shown). The rotation of steering wheel 101 causes a movement of the potentiometer slider, and therefore the generation of an electrical signal univocally correlated to the position of steering wheel 101.

When steering wheel 101 has a total stroke that is more than 360 degrees, that is, more than a single turn, for instance, two turns or two turns and a half, the potentiometer slider may be dynamically connected to the shaft of the steering wheel with a reduction unit or with a reduction gear adapting the stroke of the steering wheel to the potentiometer slider.

The potentiometer is connected to a control and command unit 201, indicated herein as a rudder unit. Rudder unit 201 is an intelligent local unit and comprises a central processing unit (CPU) that includes a memory where an operating, control, and processing program is stored. The CPU further controls a communications unit having inputs and outputs for electrical signals coded according to a communications protocol, for instance, according to the communications protocol named BUS CAN. Moreover, rudder unit 201 comprises an input point for data or command devices and one or more outputs points for one or more indicator devices, such as an acoustic indicator or the like.

More particularly, an output point of rudder unit 201 is connected to an indicator 301 of the angle set by steering wheel 101 for a steering device, such as a rudder or the like. Said indicator 301 is indicated herein as rudder angle indicator or rudder indicator.

The signal generated by the potentiometer and supplied to rudder unit 201 is transmitted from the communications unit to a communication line 401 that operates according to the BUS CAN protocol, and is further supplied to a control and processing unit that is connected to a device that actuates the steering mechanism, for example, a rudder blade.

Means for inputting data or commands, shown in the first embodiment as a control panel 501, are also connected to one input point of rudder unit 201.

A control and processing unit 4 is connected to the device that actuates the steering mechanism and comprises a control unit that regulates the power supply to an electric motor driving a hydraulic pump 8. Such hydraulic pump is part of a closed hydraulic circuit that supplies a double-acting hydraulic actuating cylinder 9. Control and processing unit 4 may have a structure similar to rudder unit 201, and may comprise a feedback unit connected to hydraulic cylinder 9 which generates and transmits on communication line 401 a signal indicating the actual angular position of the steering mechanism. Such feedback unit preferably comprises a sensor that detects the position or stroke made by hydraulic actuating cylinder 9 and that provides a signal to a control and processing unit 601. The latter generates the feedback signal coded according to the communications protocol and transmits said coded signal on communication line 401. Said feedback signal may be received and read by any electronic control and processing unit connected to communication line 401, more particularly, by rudder unit 201 and to the control and processing unit 4.

Each control and processing unit may also comprise memories for storing operating data and parameters, which are read and used by one or more resident control and operating programs that set specific options in the system operating modes.

Figure 3:
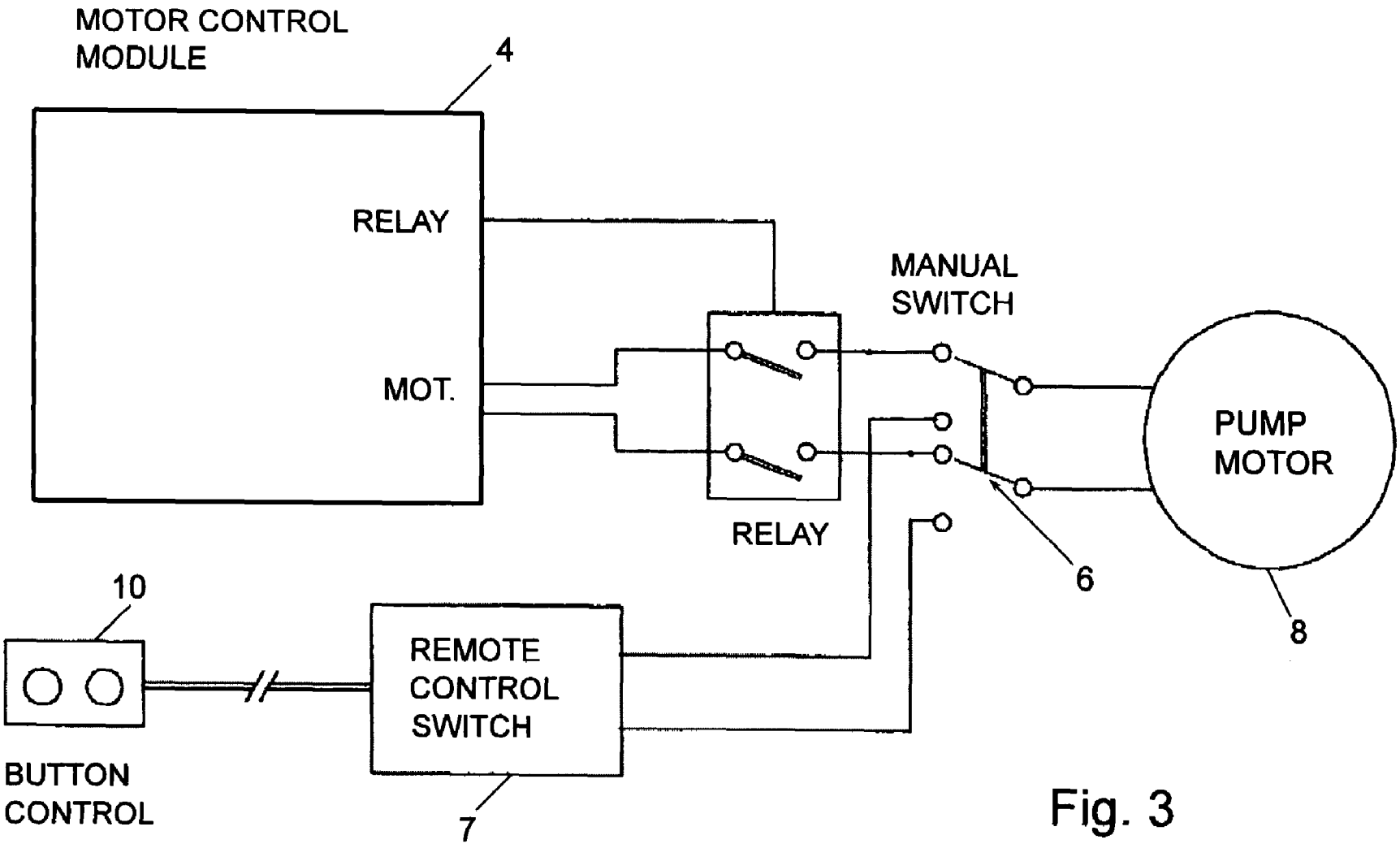
FIG. 3 is a circuit diagram of the emergency system of the first embodiment of the invention.

Referring now to FIGS. 1 and 3, electrical power is supplied to the system by a power supply, preferably as a battery 5. Moreover, an emergency directional control system is provided in parallel with the directional control system, enabling the replacement of control by the steering wheel in the event of failure or damage to the electrical portion of the directional control system. In order for the emergency system to operate properly, the hydraulic portion of the directional system must continue operation during an emergency situation.

For that purpose, a switch 6 is provided that connects alternately to the power supply battery the electrical portion of the directional control system or an emergency circuit for directly supplying the motor of pump 8. Such emergency circuit comprises a remote control switch 7 connecting the electric motor to battery 5, and a button control 10 connected to remote control switch 7. In turn, button control 10 comprises at least two buttons, one button for each rotation direction of the motor. Typically, the emergency directional control buttons on button control 10 are mounted on the control panel and may comprise means for inputting data or commands 501.

Switch 6 may be actuated manually or automatically, when combinations of sensors are employed in relation to the operating parameters of the system's electric portion and diagnostic programs.

Referring more particularly to FIG. 3, switch 6 alternately connects the power supply to the pump motor via the motor control unit 4 or via the remote control switch 7. While the direct control by means of emergency buttons provides the connection of the pump electric motor to the power supply during the time the button is pressed, in normal operating conditions the control unit of pump motor 8 connects a power supply output of control unit 4 to the pump motor by means of a relay driven by control unit 4. In either case, it should be noted that the speed required to change the position of the steering mechanism is substantially fixed, and that the position required by steering wheel 101 is set by acting on the time for connecting pump motor 8 of the pump to the electric power supply.

As an alternative to fixed speed, a maximum speed and a minimum speed may be provided for the movement of the steering mechanism. In such a case, the steering mechanism is moved at a speed that is the same as, or proportional to, the speed of movement of the control element, when the speed of movement of the control element or a speed proportional thereto is within the range of said maximum speed and said minimum speed. On the contrary, the steering mechanism is moved at said minimum speed and said maximum speed when the movement speed of the control element, or the speed proportional thereto, is equal to a speed of the steering mechanism that corresponds to said maximum or a higher speed, and that corresponds to said minimum or a lower speed.

Such fixed speed, or said minimum and maximum speeds, may be freely set by the user or may be selected among different predetermined values.

As an alternative or in addition to the above speed determinations, means for determining the sailing speed of the marine vessel and/or the running rate of motor or motors may be provided, and also for changing the fixed speed or the minimum and maximum speeds for moving the steering mechanism within predetermined limits according to the sailing speed and/or running rate of motor or motors. In such a case, means for detecting the sailing speed and/or the running rate of the motor or motors may provide a signal corresponding to said sailing speed and/or said running rate of the motor or motors to the power supply unit of the electric motor of the pump that supplies the hydraulic cylinder, and the ratio between the movement speed of the steering mechanism and the movement speed of the control element may be changed by the power supply unit according to said sailing speed and/or said running rate of the motor or motors.

Alternatively, the power supply unit of the motor changes or sets the value of fixed speed or of maximum speed and minimum speed for moving the steering mechanism according to said sailing speed and/or said running rate of motor or motors.

The power supply unit may also comprise a memory wherein a table of possible movement speeds of the steering mechanism is stored for reference to said fixed movement speed and/or said minimum and maximum speeds on the basis of predetermined and different sailing speeds and/or predetermined and different running rates of the motor or motors. Therefore, the fixed and/or maximum and minimum speeds may be selected by comparing the speed signal of the marine vessel and/or the running rate of the motor or motors with said table. The table may be also replaced by an algorithm.

By means of the above system structure it is possible to provide a great number of functions for the system that can be easily changed and adapted to the user needs.

In the following sections of the description of the invention, different tasks will be disclosed, which may be integrated into the directional control system by means of subroutines and modules of the control and operating program related to the electronic control and processing units, such as the rudder unit 201 and/or the control unit of the motor.

A. Curve for Correlating the Angular Position of the Steering Wheel and the Position of the Steering Mechanism A particular function may be provided that correlates the angular position of the steering wheel or of the stroke made by it with the position of the steering wheel. Said function may change depending on the type of maneuvering, for example normal cruising mode or mooring mode. The correlation function may be non-linear, and such to cause a different response between the movement of the steering wheel and the movement of the steering mechanism for stroke ranges of the steering wheel or of any other control element and/or for ranges of steering angles.

Further, said function may be adapted to different actual steering responses of the marine vessel from the straight traveling line in relation to different positions of the steering mechanism and with respect to water.

The function may be in the form of a computational algorithm integrated as subroutines in the control program of the rudder unit and/or in the control unit of the pump motor. In such a case, for each movement or new position of the control element, that is, of the steering wheel, the corresponding stroke or the new position of the steering mechanism is computed. The user changes the function by inputting different parameters. In this case it is also possible to provide different functions.

In addition to freely setting a correlation function and/or parameters of the correlation function, a memory or a memory area in rudder units and/or in the control unit of the pump motor may be provided, in which memory area and/or memory different functions or different function parameters are stored, which are optimized for the type of ship and for specific ship steering conditions, for example, for the condition of cruising navigation and/or ship steering during maneuvering, and/or for the speed conditions, and/or for the conditions of the sea and of the navigation sheet of water.

Instead of providing a function that is computed by an algorithm each time, the different functions may be provided as tables, wherein parameters that are intermediate between two subsequent values of a table and that correlate the stroke or position of the control element and stroke or position of the steering mechanism are determined by means of interpolation.

Therefore, in order to easily set the function correlating the stroke or position of the control element with the stroke or position of the steering mechanism, the system provides means for inputting a command that change the correlation function or parameters thereof; means for selecting and calling up stored values of parameters or correlation functions, or for inputting values of parameters or correlation functions; and means for inputting a confirmation of the selection and/or a confirmation of the parameters or of the inputted correlation function, as well as a memory or a memory area for said parameters of the correlation function and/or for different correlation functions. At the same time, the control and operating program of the rudder unit and/or motor control unit has a subroutine changing the correlation function and/or the parameters of the correlation function that writes, and the subroutine reads said function and/or said parameters in the memory dedicated thereto, and also addresses the control and operating program to the function or parameters selected by the user or to the function and parameters selected by the manufacturer or installer of the system.

B. Self-Adjustment

Due to the presence of a detector of the steering angle set by the control element, that is, of the nominal angle, and due to the presence of a detector of the actual position of the steering mechanism, an automatized subroutine may be provided that compensates the mechanical and electrical tolerances of the two system portions.

In this event, a comparison is carried out between the value of the steering angle set with the control element, that is, with the steering wheel, and the actual position taken by the steering mechanism, and, based on said comparison, a correction function is computed and added to the correlation function, or a new correlation function or new parameters of the correlation function may be determined. Such a correction function may have the form of an algorithm or a table, and may be different for different position gaps of the control element and/or of the steering wheel.

The self-adjustment subroutine may be provided within the operating and control program of the rudder unit and/or within the operating and control program of the control unit of the pump motor.

Therefore, the correction function is stored in a dedicated memory area, and the self-adjustment subroutine directs to said memory the operating and control program.

C. reversal

A reversing function may be provided that reverses the movement direction of the steering mechanism with regard to the movement direction of the control element, according to a command of the user that is generated with input means. Advantageously, such reversing condition may be shown by indicating means provided on the control panel of control station or stations.

Again, the reversing function may be advantageously carried out by providing a reversing subroutine in the operating and control program of the rudder unit and/or of the control unit of the pump motor.

D. Stop Setting

This function sets limits to the control element stroke, that is, to the steering wheel, to the steering mechanism, to the rudder, or to the actuator moving said steering mechanism, in order to compensate possible variations related to electrical and mechanical tolerances and on the specific installation.

This function is activated by inputting a command for setting a stop. The operating and control program instead comprises a subroutine for setting stops that is called up and executed.

Stop positions of the control element and of the steering mechanism are locally set, therefore, the subroutine for setting the stop is called up by means of commands that actuate it. This function provides the automatic movement of the steering mechanism in the direction that corresponds to an increase in the control signal of the control element. The steering mechanism is set with a movement speed that is lower than maximum, and the automatic movement of the steering mechanism is carried out to reach the mechanical stop. Such a position is detected and stored, and a stop position of the steering mechanism is then set, which is slightly upstream of the mechanical stop position in the direction approaching the mechanical stop. By means of visual indicators the user is asked to rotate the control element in the direction of the stop of the control element, which corresponds to the stop position at which the steering mechanism has been automatically brought. Once said stop position of the control element has been reached, the system asks the user to confirm it by a confirmation command set by input means. Such command causes position signals of the steering mechanism and/or actuating cylinder and control element to be stored. It is to be noted that the stop position of the control element must not necessarily correspond to the mechanical stop position thereof.

In order to determine opposite stops, the control element is again automatically moved in the opposite direction, that is, towards the opposite stop, namely in the movement direction corresponding to a decrease of the control signal generated by the control element. The steering mechanism is brought to said opposite mechanical stop position and a stop position slightly upstream of the mechanical stop position is recorded in the direction of movement of the steering mechanism towards the second mechanical stop. The user is asked by indicating means to move the control element in the direction of the second stop position that corresponds to the second stop of the steering mechanism, and once said position is reached the corresponding signal is stored with a confirmation command inputted by the user.

In a subsequent third step, the corresponding central positions of the steering mechanism and of the control element are set.

On the basis of the two stop positions, the steering mechanism is automatically brought in a position corresponding to a central position between the two stop positions. Therefore, the user is asked to move the control element to the position to be correlated to the central position of the steering mechanism, and once said position is reached, the user confirms it, causing the signals to be stored that correspond to the central position of the steering mechanism and to the central position of the control element.

Automatized functions may be provided for controlling the coherence of stop positions and of the central position of the steering mechanism with the stop positions and central position of the control element. In this case, the subroutine determining the stops provides the comparison of pairs of the stops and of the central position of the control element and of the steering mechanism. Moreover, the computation of the signal may be provided that corresponds to the central position of the steering mechanism and of the control element, while the signal generated by the steering mechanism and by the control element in their respective central positions is compared with the signal computed for said central positions. The user receives then an indication of the possible differences or non coincidence within specific tolerances, and of the movement direction of the control element for causing the signal actually generated by the control element and the signal computed on the basis of stored stop signals to coincide.

As for the control element, such a possible difference causes the automatic definition of a position correction that is generally intermediate with respect to the difference between the computed value and the value actually set.

E. Transfer of Control Among Various Control Stations; Enabling/Disabling

As disclosed above, the system according to the present invention may comprise two or more control stations, which can have the same tasks. Each control station is made substantially in the same manner with regard to the operating units necessary for the steering control. Each operating unit is univocally identified by a code, and the operating and control program comprises a subroutine for enabling and disabling individual control stations, and further generates an enabling/disabling signal that is transmitted to the control unit of the pump motor.

Control stations are enabled/disabled by inputting a command for enabling/disabling the station in the form of a predetermined sequence of pulses.

By means of a subroutine for transferring the control between one station and the other, it is possible to transfer the control to any control station. The transfer occurs by disabling the control station in operation and subsequently by enabling any of the control stations not in operation. The transferring subroutine may be provided in the operating and control program of the rudder units and/or in the operating and control program of the control unit of the pump motor, and controls if a signal is present for the enabled control station condition when the function enabling a different station is executed, while such second station only is enabled if there are no enabled stations. If there are any enabled stations, an error signal is emitted and the control station in operation may be shown by means of indicators. The control station in operation is further identified by means of the enabling signal and the identification code transmitted therefrom.

Different enabling modes are possible.

A first mode enables a control station only under two conditions, namely, if no other stations are enabled when the control element is in the position corresponding to the position of the steering mechanism.

A second mode enables only if there are no other control stations in operation, while the command signals of the control element are not considered by the control unit of the pump motor until the steering wheel is brought in a position corresponding to that of the steering mechanism. After the control element has reached this position, command signals provided by the control element to the control unit of the pump motor are processed, in order to control the movement of the steering mechanism. Visual or acoustic means may also be provided for indicating the alignment condition of the position of the control element with the position of the steering mechanism.

F. System Actuation

The system actuation may be provided in the form of a subroutine that sets all the control stations in the disabling condition when the system is powered up. Therefore, it is necessary to enable a control station according to the above modes.

When the system is actuated, the steering mechanism may be automatically brought to a predetermined position by means that provide an easy identification of the corresponding position of the control element, for example, for one of the two stop positions or for the central position.

G. Diagnostic Functions

The structure of the system according to the present invention provides a plurality of diagnostic functions in combination with suitable sensors.

H. Control Station Defects

As for control stations, the following diagnostic functions may be provided:

Detecting absence or defect in the analogue signal generated by the potentiometer or by another electromechanical transducer driven by the control element. In this case a diagnostic portion is provided by the control and processing unit, that is, the rudder unit controlling the presence and correctness of any input signal parameters.

Detecting the absence of a steering control signal on the communications line. Such check may be carried out by a diagnostic unit provided in the control unit of the pump motor and/or in the communications portions thereof and of the control unit associated with the control element.

Error condition of the rudder. The diagnostic portion of the control unit of the control element carries out even the detection of this condition.

Stop setting absent or not correct.

Control signal with parameters outside of predetermined parameter ranges.

Even for the previous two steps, the check is carried out by the diagnostic portion of the control unit of the control element, more specifically, of the rudder unit.

As for the control unit of the pump motor, the following conditions are detected:

Reaching the limit of absorbed current.

Absence of a life signal of the motor, either generated by motor itself or by an associated detector.

Overheating of the power portion the control board of the pump motor, detected by one or more temperature sensors connected to corresponding inputs of the diagnostic portion of the control unit of the pump motor.

Lack of coherence between motor control and movement of the actuating cylinder, by means of the feedback unit of the steering mechanism position.

Even in this case, possibly in combination with specific sensors, checks are carried out by a diagnostic subroutine of the control and operating program of the control unit of the pump motor.

Defects of the feedback unit:

Unsuccessful reception of received indication of set up data by the feedback unit.

Feedback signal beyond a higher and lower limit.

Absence or non correctness of the analogue input signal to the feedback unit that is generated by the detector of the position of the steering mechanism or of the actuating cylinder.

Unsuccessful reception of stop data.

Absence of feedback signal.

Checks are carried out by a diagnostic portion inside the feedback unit and/or by diagnostic portions of other command or control units, more specifically, of the rudder unit and of the control unit of the pump motor.

In combination with said diagnostic functions, additional control functions may be provided, regarding for example:

Wrong response of the cylinder with respect to the movement of the control element.

Power supply voltage of electronic circuits too low or too high.

Power supply voltage of the control unit of the pump motor too high or too low.

Power stage self-protection.

Anomalous reset of the control element and/or motor and/or feedback unit.

Memory check of rudder unit and/or control unit of pump motor and/or feedback unit.

Moreover, two indicating modes are provided by means of suitable light means or other visual indicating means and/or acoustic indicating means.

Diagnostic subroutines can indicate two error types, namely, non fatal errors and fatal errors, while visual indicating means are composed of light means.

Acoustic indicating means may be deactivated or an automatic deactivation may be provided after a certain amount of time, during which the acoustic indication has been in operation.

Moreover, the generation of a report file may be provided concerning error conditions, which report file may be stored in specific memories of the rudder units, of the control unit of the pump motor, and of the feedback unit.

By use of displaying means, such as a monitor or the like, it may be possible to call up and control the sequence of error indications and the unit to which the indication relates.

I. Activation of the System in Non-Fatal Error Condition

In this case, the invention provides a subroutine keeping the system in operation and enabling at least a main station. Advantageously, a temporary actuation mode is provided that causes a certain decline level of tasks to which error indication/indications refer. In turn, the operating decline may cause a partial deactivation of the control as regards a movement direction of the steering mechanism and/or the reduction in the movement speed of the steering mechanism. Moreover, the directional system according to the present invention provides the automatic clearing and the automatic interruption of the error condition in case of a spontaneous elimination of the indicated error condition. A management of error indications may also be provided, which enables the arranging and resetting of the system condition.

In case of a series of error conditions, indications are provided, to be communicated according to a specific hierarchy based on the error importance or on the time that the error indications goes on. Both for fatal errors and non fatal errors it is possible to make a list of errors that can be looked at by selecting means. Local subroutines for indicating fatal errors are also provided in control stations not in operation.

The marine vessel may comprise additional control systems, such as a system for controlling the running rate of the motor and for controlling the reverser, which sets forward gear, reverse gear, and neutral condition working with control means (such as levers or the like) that generate command signals transmitted on a communications line to actuators for determining the running rate of the motor and the reverser in similar fashion to the steering control elements. The present invention provides then that the directional control system and the control system of the running rate of the motor or motors be independent one from the other, while an interfacing and synchronization unit is provided, which has communication channels connected to communication lines 401 of the directional control system and of the control system related to the running rate of the motor or motors and of the reverser.

Figure 4:
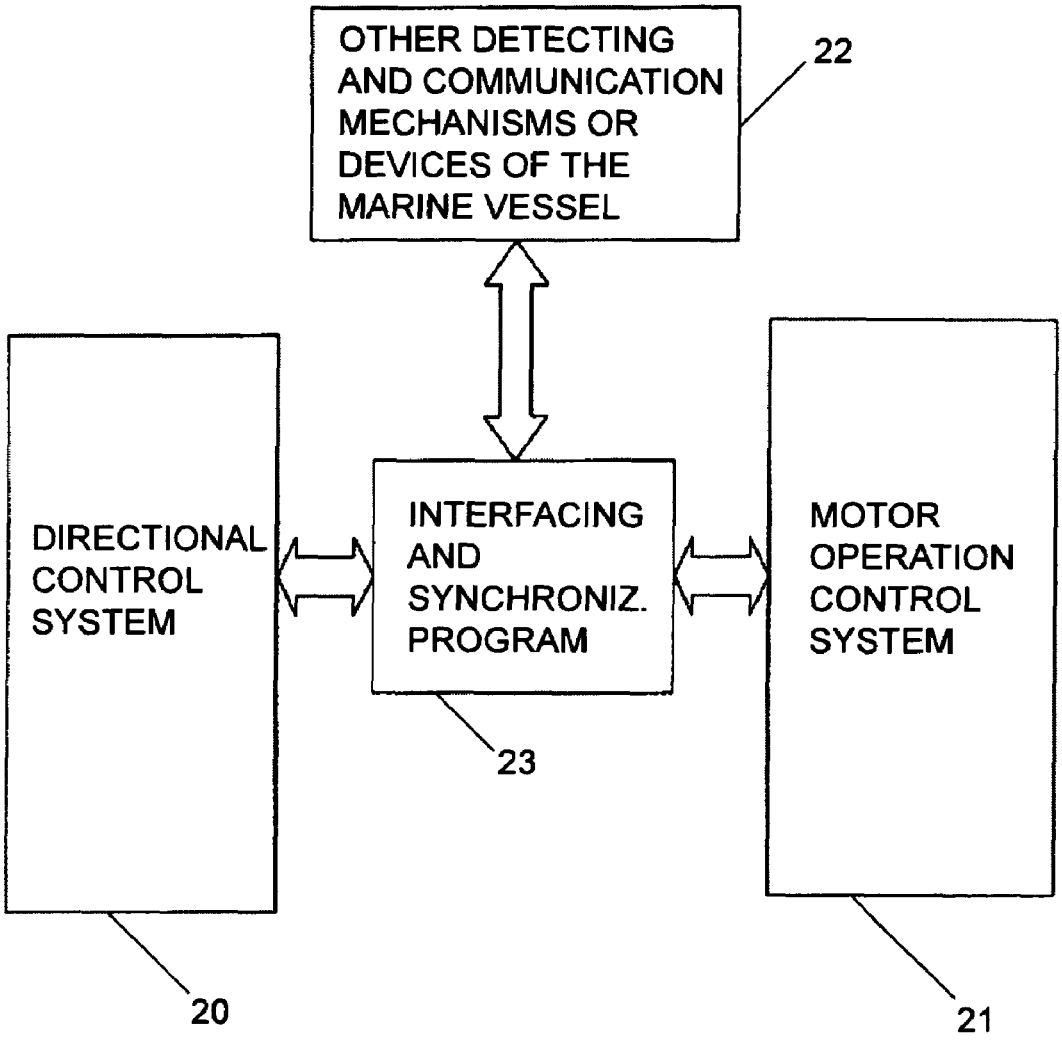
FIG. 4 is a block diagram illustrating a control system according to the present invention, wherein the control system is connected through a communication interface to a plurality of devices on the marine vessel and wherein the control system controls the running rate of motors and the commutation of the running direction among forward gear, reverse gear, and neutral.

FIG. 4 shows such architecture. The directional control system disclosed in the present invention is indicated by reference numeral 20. The control system of the running rate of motor or motors is indicated by reference numeral 21. Optional measuring or steerage and/or telecommunicating devices of the marine vessel are indicated by reference numeral 22, such devices having at least a communication output coded according to a protocol for exchanging data and commands with other devices. The interfacing and synchronization unit is indicated with reference numeral 23.

This interfacing and synchronization unit comprises a CPU, a memory for a program that synchronizes tasks of the two systems, and at least a channel that communicates with communication lines 401 of the directional control system and of the control system of the running rate of the motor or motors and of the reverser. In this case, it is possible for the synchronizing program to have a subroutine for controlling the tasks of the two systems.

For example, command signals of position or stroke of the steering mechanism, and command signals of the running rate of motor or motors, are supplied to the interfacing and synchronizing unit, while means for comparing said command signals with a reciprocal compatibility and congruity table are provided. Such table may correlate position ranges of the steering mechanism to ranges of the running rate of the motor that are compatible with said position gaps of the steering mechanism according to criteria for a safe execution of steerage maneuverings with reference to the type of ship, while at least an indication is generated when directional command signals and command signals of the running rate of motor or motors are not within values included in said ranges. It is also possible for the interfacing and synchronizing unit to take control of the directional system or of the system setting the running rate of the motor, automatically correcting at least one signal of the directional command signals or running rate setting signals, such to satisfy conditions defined in the correlation table.

A further important task is the synchronized control of the transfer of control from a control station to another control station. Generally, directional control elements and mechanisms controlling the running rate of motor and reverser are integrated in a common control station. When a control station is disabled and another control station is enabled, the interfacing and communications unit automatically deactivates the first station and actuates the second station for both systems. In this case there is provided a subroutine for transferring the disabling/enabling command that generates a control signal disabling/enabling the control station for both the directional control system and the motor running rate control system. Modes can be carried out as the above with reference to a single station.

The interfacing and synchronizing unit may provide additional inputs of signals generated by further devices or units such as a radar or sonar or a satellite system determining the position, a compass signal, an automatic pilot system, and measurement data relevant to weather conditions and provided by tools measuring pressure, wind speed, and wind direction, among others.

To this end, the interfacing and synchronizing unit may have different communication units working with different communication protocols, and, therefore systems and devices are caused to work according to different communication protocols to feed or read data from said interfacing and synchronizing unit.

From the above description, the advantages of the present invention are then clear. It is to be noted that the actuating cylinder can be replaced with an electromechanical actuator or the like. In this case it is also possible to further simplify the system, since it is no longer necessary to provide the hydraulic circuit.

J. Functions for Correcting Differences Between Set Directional Steering and Actual Directional Steering.

The electromechanical transducer that generates the electric signal correlated to the stroke made by the control element or to the position taken by the control element, or the possible associated electronic control and processing unit, are connected to a device indicating the position set by the steering mechanism, which position results from the stroke made by the control element or from the position thereof (also called rudder angle), according to the correlation function provided in the operating program. Moreover an electromechanical detector for the actual position of the steering mechanism (also called actual rudder angle) is associated to the hydraulic actuator and/or the shaft of the steering mechanism, while the signal generated by said detector is transmitted to the electromechanical transducer or to the associated electronic control and processing unit and/or control and processing unit associated to the actuator that moves the steering mechanism.

One or both of said control and processing units have a portion for comparing the nominal rudder angle set by the control element with the angular position actually taken by the steering mechanism, that is the actual rudder angle. The comparing portion generates warning and/or correction and/or error signals, or controls separate alarm circuits.

Alternatively or in combination means for detecting the route direction of the marine vessel are provided, such as a compass, a global positioning system (GPS) to detect position or a system for defining the position by means of electromagnetic signals, such as beacon signals or the like. These means generate electrical signals univocally correlated to the route direction. In this case, instead of or in addition to the above the comparing portion compares the nominal rudder angle set by the control element with the actual route direction of the marine vessel generating warning and/or correction and/or error signals or controls separate alarm circuits. In this case, the correction is an automatic one and so limits of correction angle of marine vessel direction and/or position correction of the steering mechanism are set.

This task is very advantageous, for example during the navigation in rough sea, because the steering determined by the wave is automatically corrected by the system without the need for the user to manually compensate the undesired steering determined by the wave. There may be a similar situation with strong wind and/or currents.

Figure 5:
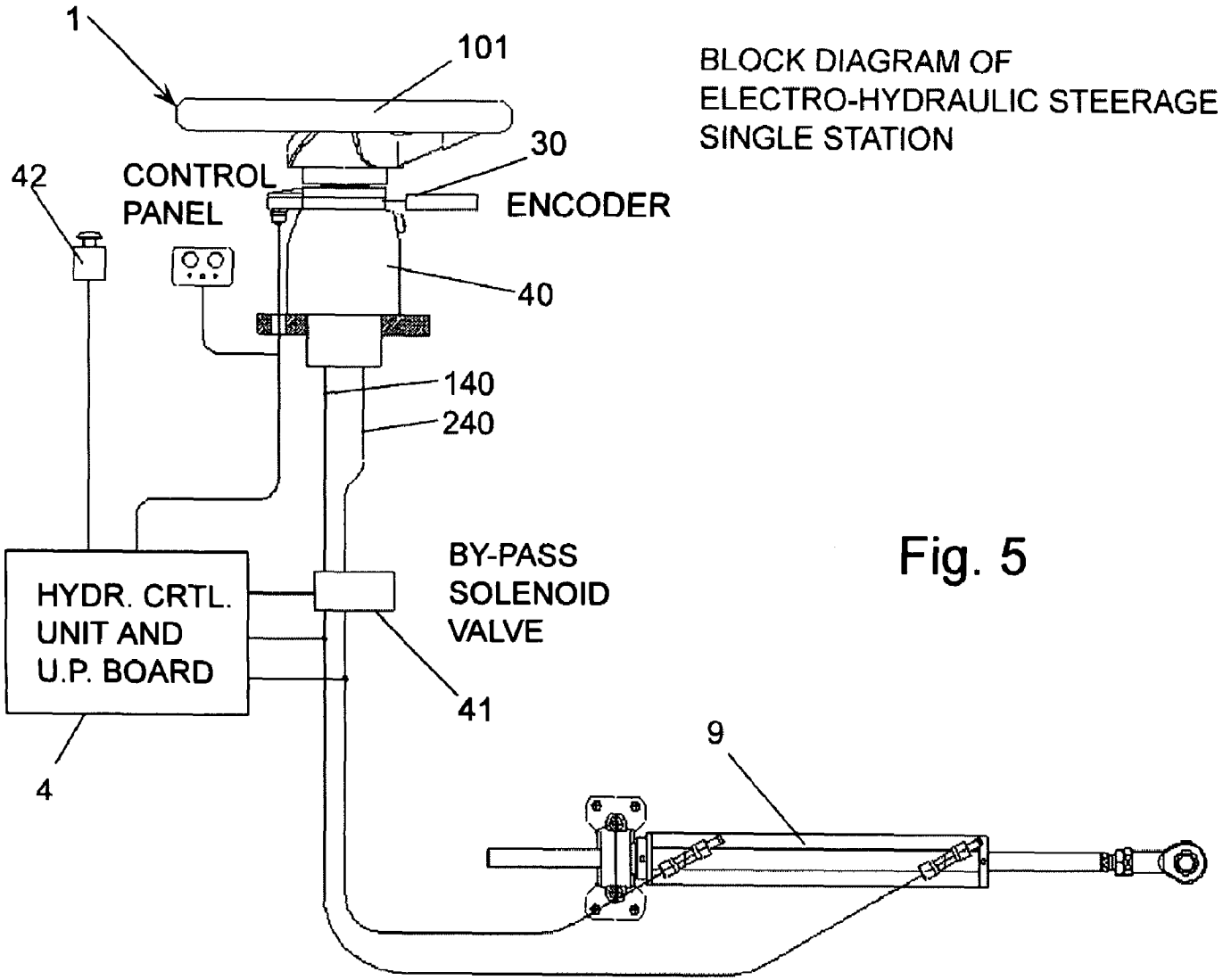
FIG. 5 is a schematic diagram of a second embodiment of the invention, wherein one control station for steering the marine vessel is provided
Figure 6:
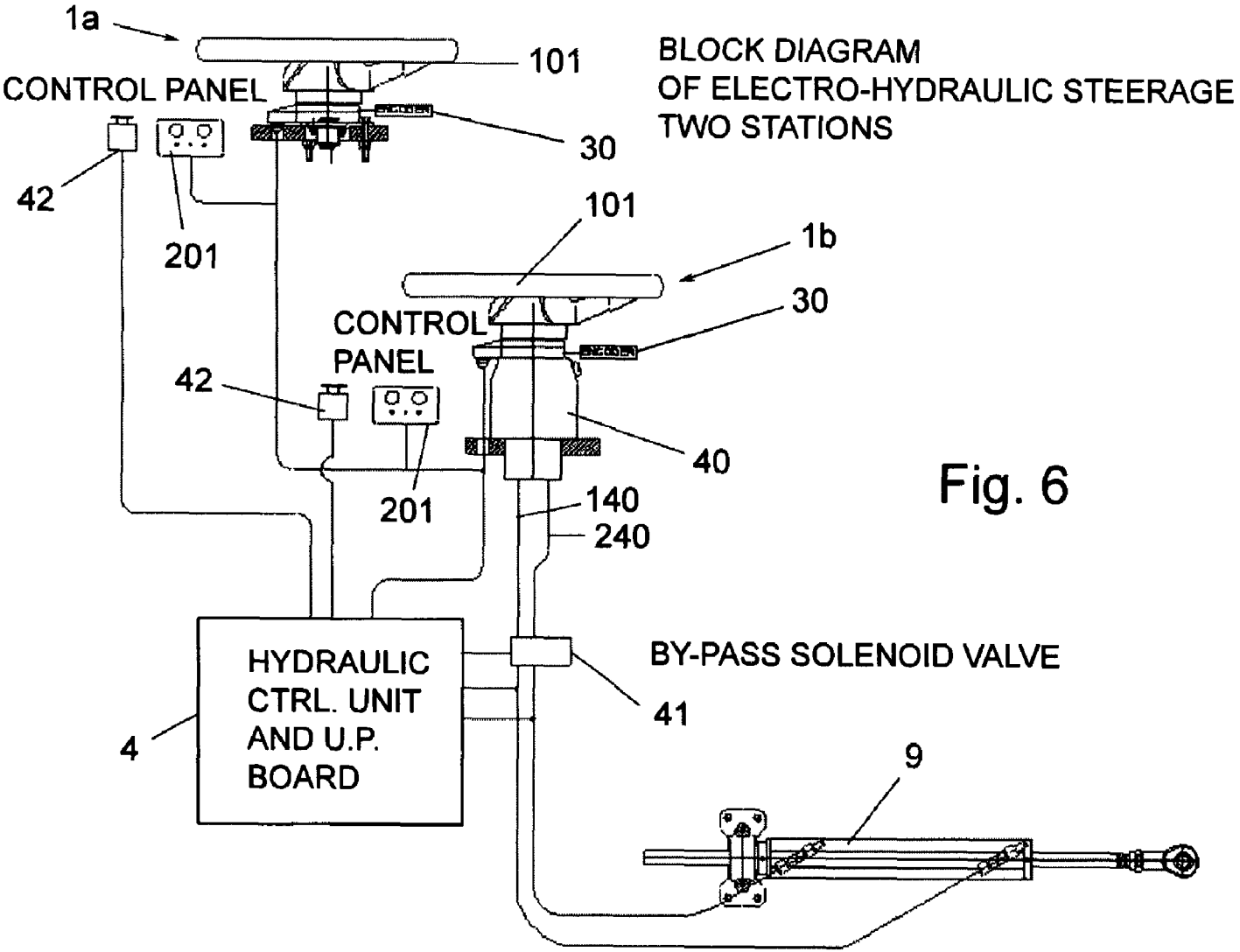
FIG. 6 is a schematic diagram of the second embodiment of the invention, wherein two control stations for steering the marine vessel are provided.

FIGS. 5 and 6 show a second embodiment of an electro-hydraulic steerage according to the present invention.

The second embodiment may comprise a single control station, as shown in FIG. 5, or two control stations as shown in FIG. 6. Contrary to the first embodiment, the directional control element, that is, the steering wheel 101 connected to the rudder, is provided in combination with an angular position sensor, preferably an encoder 30. Such encoder 30 is composed of an optical movement sensor able to generate a pulse every 2 degrees of rotation and of a digital direction discriminator.

Figure 7:
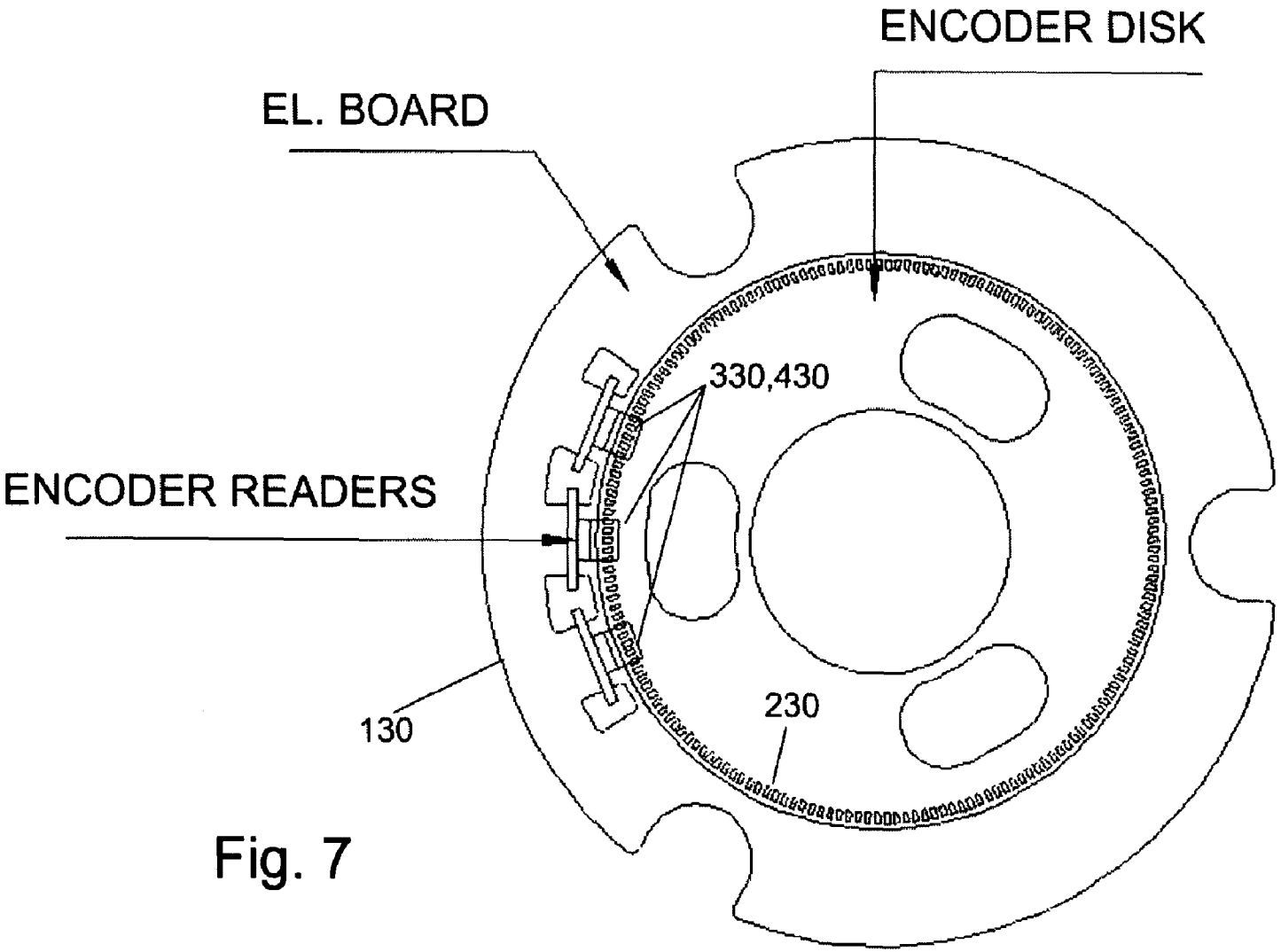
FIG. 7 is illustrates schematically an encoder for detecting the angular position of the directional control element and for detecting the direction of rotation of the directional control element, wherein the directional control element us in the form of a steering wheel.

As can be seen in FIG. 7, the encoder comprises a shielding disk 130 that is mounted coaxially to the steering wheel 101 and that can be rotate with said steering wheel 101. Along a predetermined circumference, the shielding disk 130 has a row of through slots 230 having the same shape and span. Slots 230 have the same angular width and are alternated with full areas having the same angular width.

On a disk side and in a position coinciding with the circular row of through slots 230, that is, at the same radial distance from the axis of rotation of the shielding disk 130, an emitter 330 of electromagnetic radiation is provided having a predetermined frequency, preferably in the visual or infrared spectral range, which emitter 330 is oriented towards the shielding disk 130, that is, the emitter emits radiations towards it. On the opposite side, at least a pair of detectors of said radiation is provided transforming the radiation incident thereon in an electrical signal. The two detectors 430 are also arranged that coincide with the circular row of through slots 230, that is, at the same radial distance from the axis of rotation of the shielding disk 130 and that are faced with the sensitive surface thereof towards the shielding disk 130, and, therefore, towards the emitter.

Thus the rotation of the steering wheel causes the rotation of the shielding disk 130, and consequently the running of the row of slots 230 alternated with full areas between the emitter 330 and detectors 430. Therefore, the electrical signal corresponding to the alternated exposure of the sensitive surface of the two detectors 430 to the radiation emitted by the emitter 330 is substantially an undulatory signal of the square wave or substantially square wave type. Due to a pulse counter per unit of time, that is, a combination of a timer defining a time base and a counter (not shown in detail), the number of pulses may be counted, and the speed of rotation and rotation angular range made by the directional control element 101 may be determined. The angular range can be detected because slots 230 have predetermined angular widths and angular distances therebetween that define angular feed steps of the shielding disk that can be detected by the square wave signals provided by emitter/detector pairs 330, 430. Therefore, the pulse count corresponds to a multiplying factor of the minimum angular step just defined by said constant angular widths of the slots and/or angular distances between slots of the shielding disk 130. In the present embodiment, these sizes are set in such a way so that each counted pulse corresponds to a rotation angular step of about 2 degrees.

Figure 8:
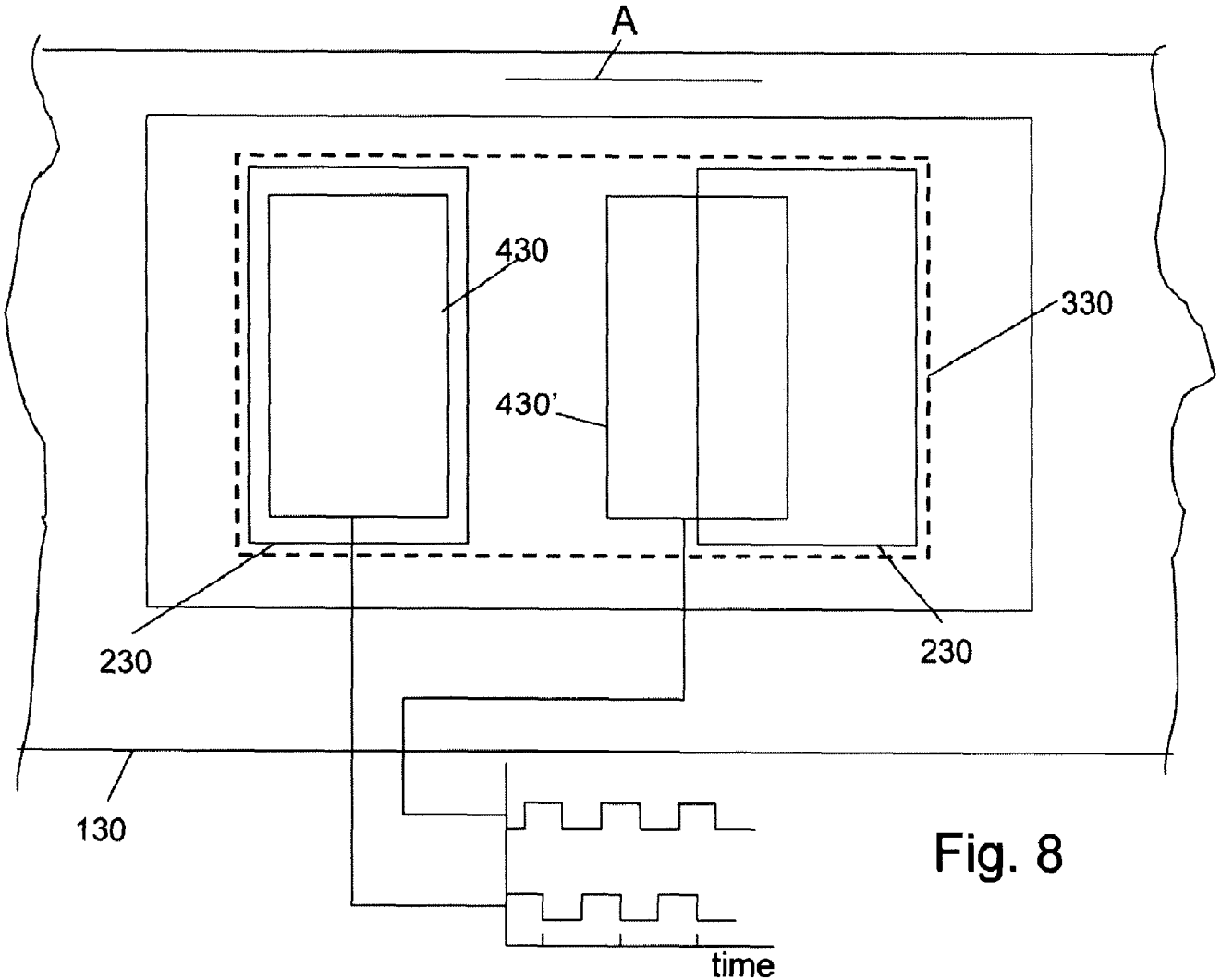
FIG. 8 is a schematic representation of the directional detection principle embodied in the linear version.

Referring more particularly to FIG. 8, the direction of rotation of the directional control element 101 and of the shielding disk is detected the two detectors 430, which are arranged at a angular distance one with respect to the other that is lower or higher than the angular distance between two slots 230 of the disk 130, or than a multiple of the distance between two slots 230 when the two detectors are intended to cooperate with two different slots that are not directly one next to the other. In the embodiment shown in FIG. 8, the angular distance between two detectors 430 is such that when one of the two detectors coincides perfectly with a slot 230, the other detector 430' overlaps only with half of the sensitive surface of the associated slot 230. That causes a phase difference in square wave signals generated by detectors 430, 430' as shown in FIG. 8. Hence, the specific and not limitative arrangement shown in FIG. 8 and disclosed herein causes the signal generated by transducer 430 to precede the signal generated by transducer 430' with a phase difference of about 45 degrees when the shielding disk 130 moves in the direction of arrow A. On the contrary, when the direction is reversed, thereby keeping an absolute value of phase difference between the two signals of the two detectors 430, 430', the signal of transducer 430' will precede the signal of detector 430. Due to this arrangement, it is possible to detect the movement direction of the shielding disk 130 and so of the steering wheel 101 in a simple and inexpensive way.

It is to be noted that FIG. 8 schematically shows the principle of the directional detector limiting the embodiment to a linear slider and not a circular one for simplicity reasons, such principle being applicable also to the circular type.

Due to the above arrangement and differently from the first embodiment, the provision of the encoder prevents steering wheel 101 or any other control element to have rotation stop means, and thus provides for a continuous free rotation of the steering wheel in one of the two directions. Therefore, it is not necessary to univocally define positions between the steering wheel and the directional steering mechanisms, for example when changing station or when actuating the system. The arrangement according to this second embodiment leaves any absolute position of the steering wheel 101 or any other directional control element out of consideration. When the station is changed and/or when the system is actuated, the central processing and control unit has only to detect the position of the directional steering wheel, while the movement thereof and the speed of movement thereof depend only on the number of pulses generated by detectors 430, 430' and from the speed at which directional control element 101 rotates respectively, that is, on the ratio between said number of pulses and the elapsed time.

Analogously to the embodiment shown in FIGS. 1-4, the embodiment according to FIGS. 5-8 comprises at least a control panel and a user interface provided with LED indicators, buttons and a buzzer for each station. The actuation of the steering mechanism, for example, of a rudder blade, occurs by means of a hydraulic actuating cylinder supplied by a reversible hydraulic pump with a direct current motor. The electronic processing unit for managing the system is associated or provided in combination with the control unit of the pump, and is further provided with a plurality of electric interfaces for receiving messages coming from both directional control mechanisms 101 of the one or more stations working in turn one with respect to the other, and from additional operating units provided as equipments on the ship and disclosed above with reference to the preceding embodiment.

It is to be noted that the hydraulic cylinder in use may be a hydraulic cylinder of the standard type.

The number of control stations may vary from a minimum of 1 to a maximum of 8, provided that such stations are coded with different part numbers, in order to avoid any interaction with the encoder by the system installer. Such a configuration is typically carried out during production.

According to a further advantageous feature that may be applied even to the embodiment illustrated in FIGS. 1-4, and with reference to any combination or sub-combination of features of said embodiment, the system provides that to the directional control element 101 may be connected a hydraulic pump 40 of the type that is traditionally used for hydraulic directional servo-controls of marine engines or ships, for example a pump of the type described in patent application EP 1 382 845 by the same applicant.

The pump comprises an axial piston rotor having an axis of rotation that, in the embodiment of FIGS. 5-6, is rotationally connected with the axis of the steering wheel 101. The pump further comprises connection piping 140, 240 connected to the hydraulic circuit in order to supply the linear actuator, shown as hydraulic cylinder 9 of the directional mechanism in the present embodiment. Connection piping 140, 240 can be connected or disconnected from the primary hydraulic circuit via a solenoid valve 41. Thus, additional security for the system has been generated deriving from a hydraulic back-up of the electric control system. For example, even if the power supply on board completely fails, at least one of the control stations may still control the steering mechanism by means of a hydraulic system that does not require any electrical supply. Solenoid valve 41 may be of a type that causes the disconnection of piping 140 and 240 from the primary hydraulic circuit only when an electrical supply is available, while it automatically connects piping 140 and 240, and, therefore, the pump 40 when there is no electric supply.

During ordinary operation, with electronic actuation, all control stations act in the same manner when selected by the user, providing signals to the managing electronic unit. When a malfunction is identified by the system, solenoid valve 41 immediately connects hydraulic pump 40 to the main hydraulic circuit, enabling the user to continue steering the rudder or any other directional mechanism of the ship.

In combination with the solenoid valve 41, a power relay may also be provided that disconnects the direct current motor of the hydraulic control unit in the event of failure of the electric system. However, each installation will include the provision of a safety button 42, with which the power supply to solenoid valve 41 will be stopped and the power relay may be activated.

In alternative to or in addition to the above, the system according to the embodiment of FIGS. 5-8 may also comprise a switch 6 connecting to the power supply battery the electric portion of the directional control system or an emergency circuit for directly supplying the motor of the pump 8, in the same manner as disclosed in relation to the first embodiment, as illustrated in FIGS. 1-4.

The processing unit for operating the system, in combination with the electro-hydraulic control unit (which includes the pump and the direct current motor), with the solenoid valve, and with a power relay capable of disconnecting the control unit, is advantageously housed inside a proper case for easing the installation and maintenance of the system.

The managing processing unit is designed to interface with command signals for reversible control units and/or with controls for solenoid valves, which are inputted from external automatic pilots of third parties. Moreover, the managing processing unit may receive tachymetry information from suitable external sensors. Thus, the system may automatically change some parameters, such as steering wheel sensitivity according to ship speed, and may undertake all compatible tasks that were disclosed with reference to the preceding first embodiment illustrated in FIGS. 1-4.

While the invention has been described in connection with the above described embodiments, it is not intended to limit the scope of the invention to the particular forms set forth, but on the contrary, it is intended to cover such alternatives, modifications, and equivalents as may be included within the scope of the invention.

The invention claimed is:

1. A method for the directional control of a marine vessel by the use of a directional control system, the directional control system comprising a control element movable between two extreme positions and a steering mechanism having a position that affects the direction of the marine vessel and that is controlled by the position of the control element, the method comprising the following steps:

generating a directional control signal univocally correlated to a stroke input, wherein the stroke input is a position or a stroke of the control element;

coding the directional control signal according to a predetermined communication protocol;

transmitting the directional control signal to an actuator; and processing the directional control signal into an actuator control signal for moving the steering mechanism into a route steering position corresponding to the position of the control element, wherein the processing of the directional control signal into the actuator control signal comprises the execution of a correlation function correlating the directional control signal with the actuator control signal, further comprising one or more of the steps of selecting and setting parameters of the correlation function and of selecting and setting one of different, available correlation functions, wherein the control element is movable between opposite stop positions and the steering mechanism is movable between two opposite mechanical stop positions, further comprising the following steps:

moving the steering mechanism independently of the control element to a first mechanical stop position;

defining a first virtual stop position for the steering mechanism that corresponds to a position upstream of the first mechanical stop position with respect to the approaching direction to the first mechanical stop position;

storing the signal related to the first virtual stop position;

manually moving the control element to a first control stop position while the reception and transmission of directional command signals generated therefrom is prevented;

storing a signal related to the first control stop position;

moving the steering mechanism independently of the control element to a second mechanical stop position opposite to the first mechanical stop position;

defining a second virtual stop position for the steering mechanism that corresponds to a position upstream of the second mechanical stop position with respect to the approaching direction to the second mechanical stop;

manually moving the control element to a second control stop position while the reception and transmission of directional command signals generated therefrom is prevented; and storing a signal related to the second control stop position.

2. The method according to claim 1, wherein central positions of the steering mechanism and of the control element are defined according to the following steps:

computing a reference signal corresponding to the central position of the steering mechanism between two opposing stops, wherein the opposing stops are the first and the second mechanical stops, or the first and the second virtual stops;

moving the steering mechanism independently of the directional control element in the position corresponding to the reference signal, and storing the reference signal as a central position signal;

moving the control element to a desired central position while the reception and transmission of directional command signals generated from the control element is prevented; and storing a signal corresponding to the desired central position as the central position signal for the directional control element.

3. A method for the directional control of a marine vessel by the use of a directional control system, the directional control system comprising a control element movable between two extreme positions and a steering mechanism having a position that affects the direction of the marine vessel and that is controlled by the position of the control element, the method comprising the following steps:

generating a directional control signal univocally correlated to a stroke input, wherein the stroke input is a position or a stroke of the control element;

coding the directional control signal according to a predetermined communication protocol;

transmitting the directional control signal to an actuator; and processing the directional control signal into an actuator control signal for moving the steering mechanism into a route steering position corresponding to the position of the control element, wherein the processing of the directional control signal into the actuator control signal comprises the execution of a correlation function correlating the directional control signal with the actuator control signal, further comprising one or more of the steps of selecting and setting parameters of the correlation function and of selecting and setting one of different, available correlation functions, wherein a central position signal is computed on the basis of stop signals of the control element, and wherein the reaching of a desired central position of the control element is indicated when the signal generated by the control element during the movement thereof coincides within predetermined tolerances with the computed central position signal.

4. The method according to claim 3, further comprising an initialization process upon activation of the directional control system, the initialization process comprising the following steps:

one or more of deactivating the transmission and reception of the directional command signal, and stopping the effect of the directional command signal until the directional control signal corresponds to the position of the steering mechanism, and activating the transmission and reception of the directional command signal, and enabling the action of the directional control signal when the directional control signal and the position of the steering mechanism correspond to each other.

5. The method according to claim 4, wherein the marine vessel comprises a plurality of directional control stations in different positions on the marine vessel, each of the plurality of directional control stations comprising a control element, further comprising a process for transferring the directional control among the control elements, the process comprising the steps of:

generating a code identifying each directional control station;

disabling the transmission and reception of directional command signals from all directional control stations; and enabling the transmission and reception of the directional control signal only when the signal generated by the control element of a selected directional control station corresponds to the position of the steering mechanism.

6. The method according to claim 5, further comprising an automatic enablement of the selected directional control station when the signal generated by the directional control element of the selected directional control station corresponds to the position of the steering mechanism.

7. The method according to claim 6, further comprising an indication of errors and malfunctions comprising the following steps:

detecting operating parameters of operating units of the directional control system;

comparing the operating parameters with value combinations thereof corresponding to error and malfunction conditions; and generating an error message that is univocally correlated to each value combination of the error and malfunction conditions.

8. The method according to claim 7, further comprising the steps of changing the correlation functions correlating the directional command signals with the command signals that move the steering mechanism, the changing being performed on the basis of a combination of system operational parameters corresponding to predetermined errors and malfunctions.

9. The method according to claim 8, wherein the directional command signal is transformed in a command signal driving one or more of an electrical motor and a hydraulic pump causing a movement of the steering mechanism.

10. The method according to claim 8, wherein a motor control system controls the operating conditions of the vessel motor by the use of motor control signals and is separated from the directional control system, further comprising the following steps to synchronize the motor control system with the directional control system:

transforming the directional control signal and the motor control signal in coded signals according to a common communications protocol;

comparing the coded signals with a compatibility table of steering maneuverings;

enabling a maneuvering corresponding to a coded directional control signal that is compatible one with a coded motor control signal; and disabling maneuverings corresponding to a coded directional control signal that is incompatible one with a coded motor control signal.

11. The method according to claim 10, further comprising the following steps:

generating the directional control signal to be univocally correlated to the stroke input;

coding the directional control signal according to a predetermined communication protocol;

transmitting the directional control signal to the actuator;

processing the directional control signal to transform the directional control signal in an actuator control signal for moving the steering mechanism to a route steering position corresponding to the position of the control element;

detecting the navigation direction of the marine vessel and any changes thereof;

comparing the directional control of the marine vessel with the actual navigation direction; and setting an automatic correction of the navigation direction of the marine vessel in conformance with the correct direction of the marine vessel corresponding to the directional control.

12. The method according to claim 11, further comprising the step of determining a maximum limit for the automatic correction of the navigation direction of the marine vessel.

13. The method according to claim 12, further comprising the following steps:

setting a steering speed value for the steering mechanism, wherein the steering speed value is a fixed speed or a speed within a maximum and a minimum speed limit;

moving the steering mechanism at a steering speed, wherein the steering speed is the fixed speed or the speed of the control element, when the steering speed is comprised between the maximum and the minimum speed limits;

moving the steering mechanism at the minimum speed limit when the speed of the control element is equal or lower that the minimum speed limit; and moving the steering mechanism at the maximum speed limit when the speed of the control element is equal or higher that the maximum speed limit.

14. The method according to claim 13, further comprising the step of manually setting the steering speed.

15. The method according to claim 13, further comprising the following steps:

detecting one or more of the navigation speed of the marine vessel and the running rate of the vessel motor; and automatically changing the steering speed value according to one or more of the navigation speed of the marine vessel and the running rate of the vessel motor.

16. The method according to claim 15, further comprising the step of selecting the manual setting of the steering speed according to one or more of the navigation speed of the marine vessel and the running rate of the vessel motor.

17. The method according to claim 16, further comprising the step of executing diagnostic checks during the activation and the operation of the directional control system.

* * * * *